US006990908B2

(12) United States Patent
Lissa et al.

(10) Patent No.: US 6,990,908 B2
(45) Date of Patent: Jan. 31, 2006

(54) TRANSPORTATION SUBASSEMBLY FOR MATERIALS DESTABILIZED IN PRESENCE OF DESTABILIZING CONTAMINANTS

(75) Inventors: Richard Lissa, Orange, CT (US); Lucius Wood, Madison, CT (US)

(73) Assignee: OCI Chemical Corporation, Shelton, CT (US)

( * ) Notice: Subject to any disclaimer, the term of this patent is extended or adjusted under 35 U.S.C. 154(b) by 0 days.

(21) Appl. No.: 10/937,025

(22) Filed: Sep. 9, 2004

(65) Prior Publication Data

US 2005/0081740 A1 Apr. 21, 2005

Related U.S. Application Data

(60) Provisional application No. 60/505,273, filed on Sep. 23, 2003.

(51) Int. Cl.
*B61D 3/00* (2006.01)

(52) U.S. Cl. ..... 105/463.1; 105/247; 206/204; 222/190; 406/197; 34/80

(58) Field of Classification Search ..... 406/197; 34/80, 168; 312/31; 105/358, 247, 248, 105/463.1; 206/204; 222/190, 263; 298/24, 298/27

See application file for complete search history.

(56) References Cited

U.S. PATENT DOCUMENTS 3,271,089 A * 9/1966 Krellen ..... 312/31.2
3,720,241 A * 3/1973 Bryant et al. ..... 141/25
4,902,173 A * 2/1990 Hendee et al. ..... 406/145
5,628,254 A * 5/1997 Ott et al. ..... 105/377.08
5,647,514 A * 7/1997 Toth et al. ..... 222/181.3
6,588,345 B1 * 7/2003 Aguirre et al. ..... 105/247

* cited by examiner

*Primary Examiner*—Mark T. Le
(74) *Attorney, Agent, or Firm*—Baniak Pine & Gannon

(57) ABSTRACT

A transportation subassembly is provided for transporting a material that is destabilized in the presence of a destabilizing contaminant. The subassembly has a structural body having a cavity constructed and arranged to receive the material to be stored, a breather assembly operatively connected to the structural body and including a container forming a chamber, the chamber being in fluidic communication with the cavity and being constructed and arranged to receive an contaminant-removing material selected to remove the destabilizing contaminant, and a venting assembly mounted with respect to the structural body. The venting assembly includes a rupture apparatus rupturable at a predetermined pressure formed within the cavity to form fluidic communication between the cavity and the atmosphere. A method for transporting a material in a transportation subassembly is also provided. A structural body having a cavity for storing the material to be transported and a rupture apparatus rupturable at a pressure formed within the cavity is used. The method includes inspecting the cavity for defects and for destabilizing impurities; dry air purging the cavity; loading the material into the cavity; activating a breather assembly to restrict destabilizing impurities from within the cavity; operatively connecting a dry air line to the cavity to form fluidic communication between the cavity and the storage compartment; and maintaining the breather assembly in an activated position to maintain the cavity in a pure condition.

2 Claims, 5 Drawing Sheets

TRANSPORTATION SUBASSEMBLY FOR MATERIALS DESTABILIZED IN PRESENCE OF DESTABILIZING CONTAMINANTS

CROSS REFERENCE TO RELATED APPLICATION

This application claims the benefit of U.S. Provisional Application No. 60/505,273, filed Sep. 23, 2003.

BACKGROUND OF THE INVENTION

A transportation subassembly is disclosed for transporting a material that is destabilized in the presence of a destabilizing contaminant. The subassembly has a structural body having a cavity constructed and arranged to receive the material to be transported, a breather assembly operatively connected to the structural body and including a container forming a chamber, the chamber being in fluidic communication with the cavity and being constructed and arranged to receive a contaminant-removing material selected to remove the destabilizing contaminant, and a venting assembly mounted with respect to the structural body. The venting assembly includes a rupture apparatus rupturable at a predetermined pressure formed within the cavity to form fluidic communication between the cavity and the atmosphere.

A method for transporting a material in a transportation subassembly is also disclosed. A structural body having a cavity for storing the material to be transported and a rupture apparatus rupturable at a pressure formed within the cavity is used. The method includes inspecting the cavity for defects and for destabilizing impurities; dry air purging the cavity; loading the material into the cavity; activating a breather assembly to restrict destabilizing impurities from within the cavity; operatively connecting a dry air line to the cavity to form fluidic communication between the cavity and the storage compartment; and maintaining the breather assembly in an activated position to maintain the cavity in a pure condition.

In the past, efforts to provide a vessel for transporting a material that is destabilized in the presence of a destabilizing contaminant have failed, as designs to seal out contaminants have provided inadequate pressure relief should decomposition occur. Thus, combining a clean, contaminant-free transportation environment while at the same time affording a pressure relief mechanism should contamination occur has largely eluded apparatus that precede the present invention.

Thus, a problem associated with vessels for transporting materials that are destabilized in the presence of a destabilizing contaminant that precede the present invention is that they do not facilitate safe, reliable and relatively inexpensive transportation of materials that are unstable or become unstable in the presence of a contaminant.

Another problem associated with vessels for transporting materials that are destabilized in the presence of a destabilizing contaminant that precede the present invention is that they do not adequately maintain the integrity of the material to be transported.

Yet another problem associated with storage vessels for transporting materials that are destabilized in the presence of a destabilizing contaminant that precede the present invention is that they are not sufficiently environmentally-safe.

Still another problem associated with storage vessels for transporting materials that are destabilized in the presence of a destabilizing contaminant that precede the present invention is that they do not provide adequate sealing to keep out contaminants while at the same time providing pressure relief to prevent failure of the transportation subassembly should the material begin to become unstable.

An even further problem associated with storage vessels for transporting materials that are destabilized in the presence of a destabilizing contaminant that precede the present invention is that they do not ensure the continued structural integrity of the transportation subassembly.

Yet another problem associated with storage vessels for transporting materials that are destabilized in the presence of a destabilizing contaminant that precede the present invention is that they do not adequately safeguard against the accidental discharge of material into the atmosphere should contamination of the material occur.

A further problem associated with storage vessels for transporting materials that are destabilized in the presence of a destabilizing contaminant that precede the present invention is that they do not afford adequate pressure relief should any decomposition or deteriorations of the material to be stored occur.

Yet another problem associated with storage vessels for transporting materials that are destabilized in the presence of a destabilizing contaminant that precede the present invention is that they do not provide a predictable transit time during which contamination or decomposition is reliably and predictably prevented.

The present invention seeks to overcome these and other problems associated with storage vessels for transporting materials that are destabilized in the presence of a destabilizing contaminant that precede the present invention.

SUMMARY OF THE INVENTION

It is an object of the present invention to provide a transportation subassembly for transporting materials that are destabilized in the presence of a destabilizing contaminant that facilitates safe, reliable and relatively inexpensive transportation thereof.

Another object of the present invention is to provide a transportation subassembly for transporting materials that are destabilized in the presence of a destabilizing contaminant that adequately maintains the integrity of the material to be transported.

A further object of the present invention is to provide a transportation subassembly for transporting materials that are destabilized in the presence of a destabilizing contaminant that is sufficiently environmentally-safe.

Still another object of the present invention is to provide a transportation subassembly for transporting materials that are destabilized in the presence of a destabilizing contaminant that provides adequate sealing to keep out contaminants while at the same time provides pressure relief to prevent failure of the transportation subassembly should the material begin to become unstable.

Yet another object of the present invention is to provide a transportation subassembly for transporting materials that are destabilized in the presence of a destabilizing contaminant that ensures the continued structural integrity of the transportation subassembly.

An even further object of the present invention is to provide a transportation subassembly for transporting materials that are destabilized in the presence of a destabilizing contaminant that safeguards against the accidental discharge of material into the atmosphere should contamination of the material occur.

Another object of the present invention is to provide a transportation subassembly for transporting materials that are destabilized in the presence of a destabilizing contaminant that affords adequate pressure relief should any decomposition or deteriorations of the material to be transported.

Yet a further object of the present invention is to provide a transportation subassembly for transporting materials that are destabilized in the presence of a destabilizing contaminant that provides a predictable transit time during which contamination or decomposition is reliably and predictably prevented.

These and other objects, advantages and features of the present invention will be apparent from the detailed description that follows.

BRIEF DESCRIPTION OF THE DRAWINGS

In the detailed description that follows, reference will be made to the following figures.

DETAILED DESCRIPTION OF A PREFERRED EMBODIMENT

Figure 1:
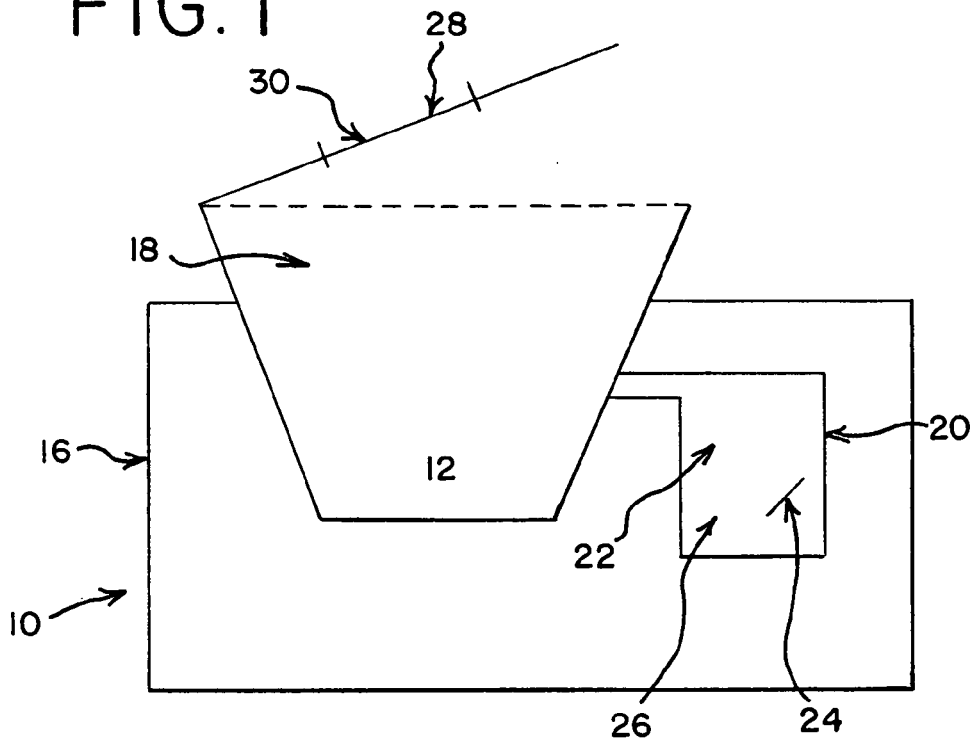
FIG. 1 is a schematic illustration of a preferred embodiment of the transportation subassembly.

Referring first to FIG. 1, a transportation subassembly 10 is illustrated schematically. The subassembly 10 is adapted to receive a material 12, such as sodium percarbonate, that is destabilized in the presence of a destabilizing contaminant, such as water or water vapor. The subassembly 10 has a structural body 16 having a cavity 18 constructed and arranged to receive the material 12 to be stored and a breather assembly 20 operatively connected to the structural body 16.

The breather assembly 20 includes a container 22 forming a chamber 24. The chamber 24 is in fluidic communication with the cavity 18 and is constructed and arranged to receive a contaminant-removing material 26, such as a desiccant, selected to remove the destabilizing contaminant. A venting assembly 28 is mounted with respect to the structural body 16 and includes a rupture apparatus 30 rupturable at a predetermined pressure formed within the cavity 18, thereby forming fluidic communication between the cavity 18 and the atmosphere.

Figure 2:
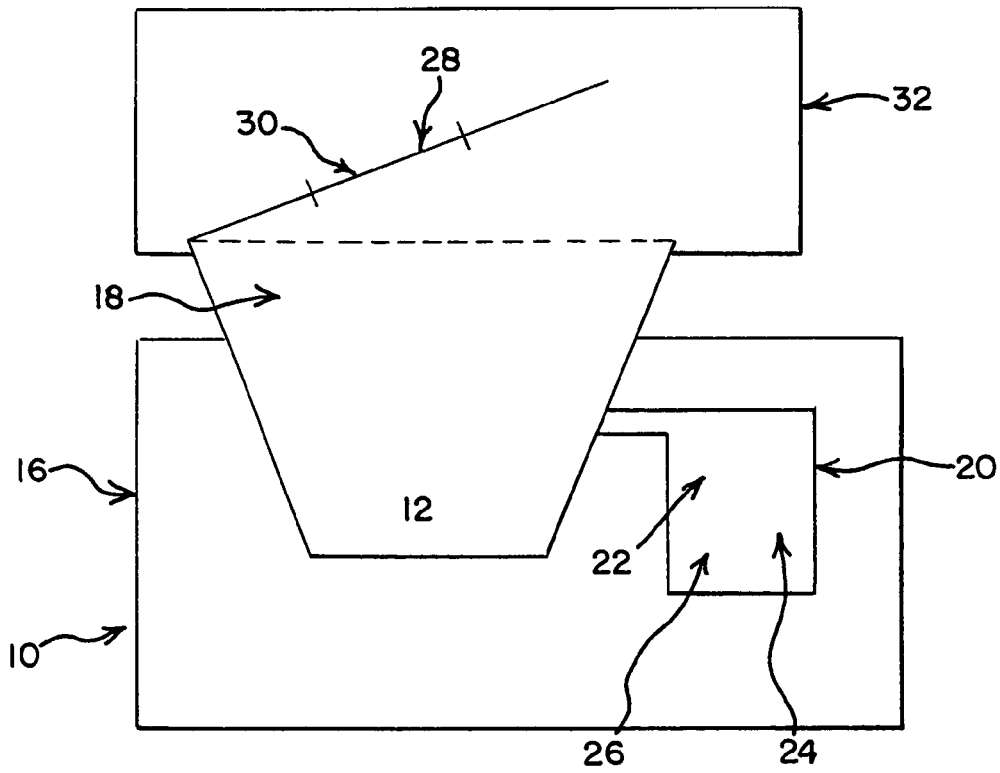
FIG. 2 is a schematic illustration of a second preferred embodiment of the transportation subassembly.

As shown in FIG. 2, an alternative embodiment of a transportation subassembly 10 is illustrated schematically. Similar to the schematic shown in FIG. 1, the subassembly 10 is adapted to receive a material 12 that is destabilized in the presence of a destabilizing contaminant, and is provided with a structural body 16 having a cavity 18 constructed and arranged to receive the material 12 to be stored. A breather assembly 20 is operatively connected to the structural body 16, and includes a container 22 forming a chamber 24. The chamber 24 is in fluidic communication with the cavity 18 and is constructed and arranged to receive a contaminant-removing material 26 selected to remove the destabilizing contaminant. A venting assembly 28 is mounted with respect to the structural body 16 and includes a rupture apparatus 30 rupturable at a predetermined pressure formed within the cavity 18, thereby forming fluidic communication between the cavity 18 and the atmosphere. Unlike the first embodiment, shown in FIG. 1, the second preferred embodiment shown in FIG. 2 is also provided with a containment top 32 that provides structural containment of the rupture apparatus 30, as additional protective structure to the transportation subassembly 10.

As shown in FIGS. 3 through 6, in the preferred embodiments, the transportation subassembly 10 is mounted on a railcar 50. The structural body 16 further has additional features and details specific to the express design of the railcar system.

Figure 3:
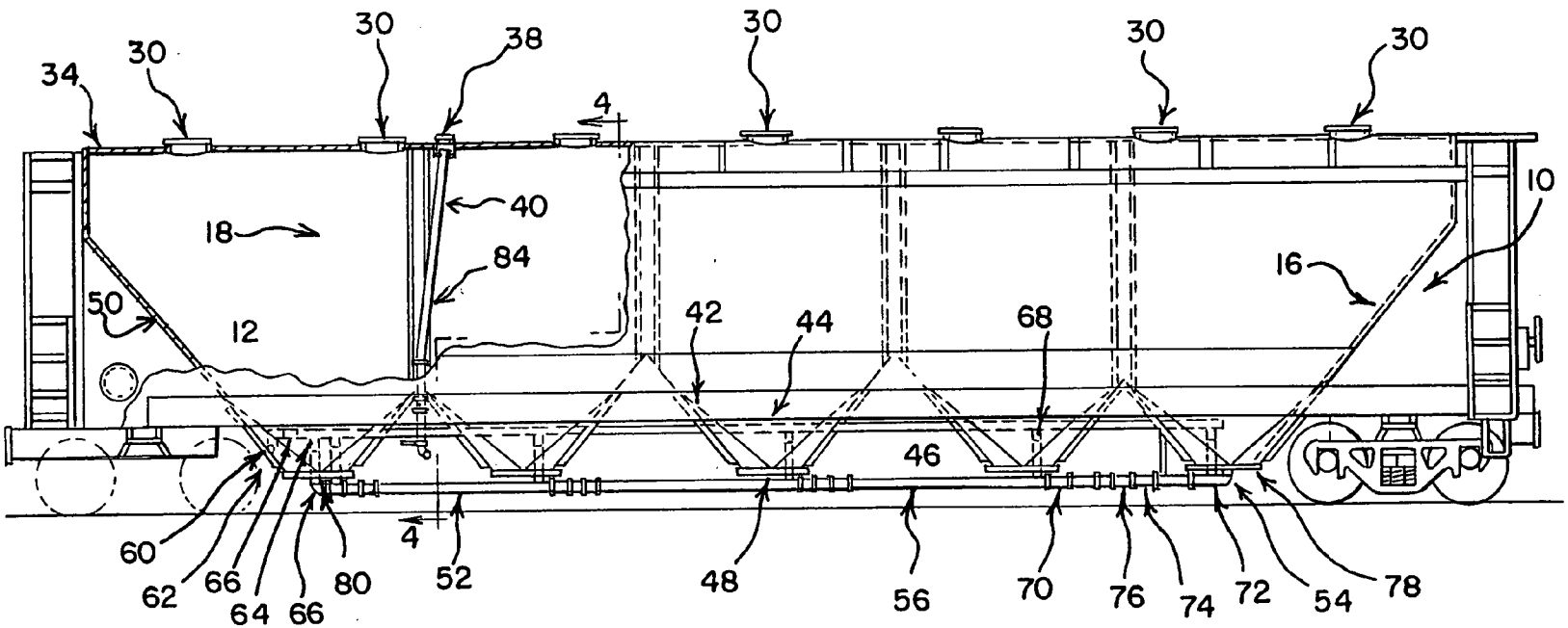
FIG. 3 is a cross-sectional view of a railcar illustrating a preferred embodiment of the transportation subassembly.

Referring now to FIG. 3, a cross-sectional view of a railcar 50 illustrating a preferred embodiment of the transportation subassembly 10 is shown. The interior of the railcar 50 defines a structural body 16 defining a cavity 18 constructed and arranged to receive the material 12 to be transported. Rupture apparatus 30 is located in multiple positions along the top 34 of the railcar 50, and at least one secondary pressure relief apparatus 36 is also disposed along the top 34 of the railcar 50. The railcar 50 has multiple hoppers 42 adapted for receiving a material 12 to be transported.

Referring still to FIG. 3, the railcar 50 is provided with a product evacuation subsystem 52. Each railcar 50 has hoppers 42 having troughs 44 positioned in the base 46 of the hoppers 42, terminating in product aerators 48. These aerators 48 are provided with exit orifices 54 that communicate with evacuation piping 56 to permit removal of material 12 from the railcar 10.

The piping 56 is generally configured to provide fluid communication between the hoppers 42 and a product discharge orifice 58 to facilitate removal of the product from the railcar. An air inlet 60 fitted with a dust cap 62 permits air to enter the evacuation piping 56 when the main aerator valve 64 is opened to permit entry of air. A first check valve 66 positioned between the main aerator valve 64 and the air inlet 60 prevents backflow of air into the railcar 50. A second check valve 66 is positioned in the lower portion of the evacuation piping 56 to further prevent backward flow of air into the railcar 50. A pressure control valve 80 is positioned within the evacuation piping 56 to regulate the operating pressure therewithin.

Individual aerator valves 68 positioned at the product discharge orifices 58 are opened to allow air to enter the aerators 48 and product valves 70 are opened to allow the material 12 to flow downward into the evacuation piping 56. Thus, as air enters the air inlet 60 and is directed into the aerators 48, it forces the product 12 from the aerators 48 into the evacuation piping 56 and directs it toward a product line 72. The product line 72 is fitted with a swing Y outlet 74 which can be pivoted upward during transportation or pivoted downward to effect loading of the product 12 from the railcar 50 to a receiving vehicle, such as a truck or customers' silo. The outlet 74 is provided with a dust cap 76. At the opposite side of the evacuation piping 56, an aerator cleanout port 78 is provided to facilitate cleaning the aerators 48 and the evacuation piping 56.

Figure 4:
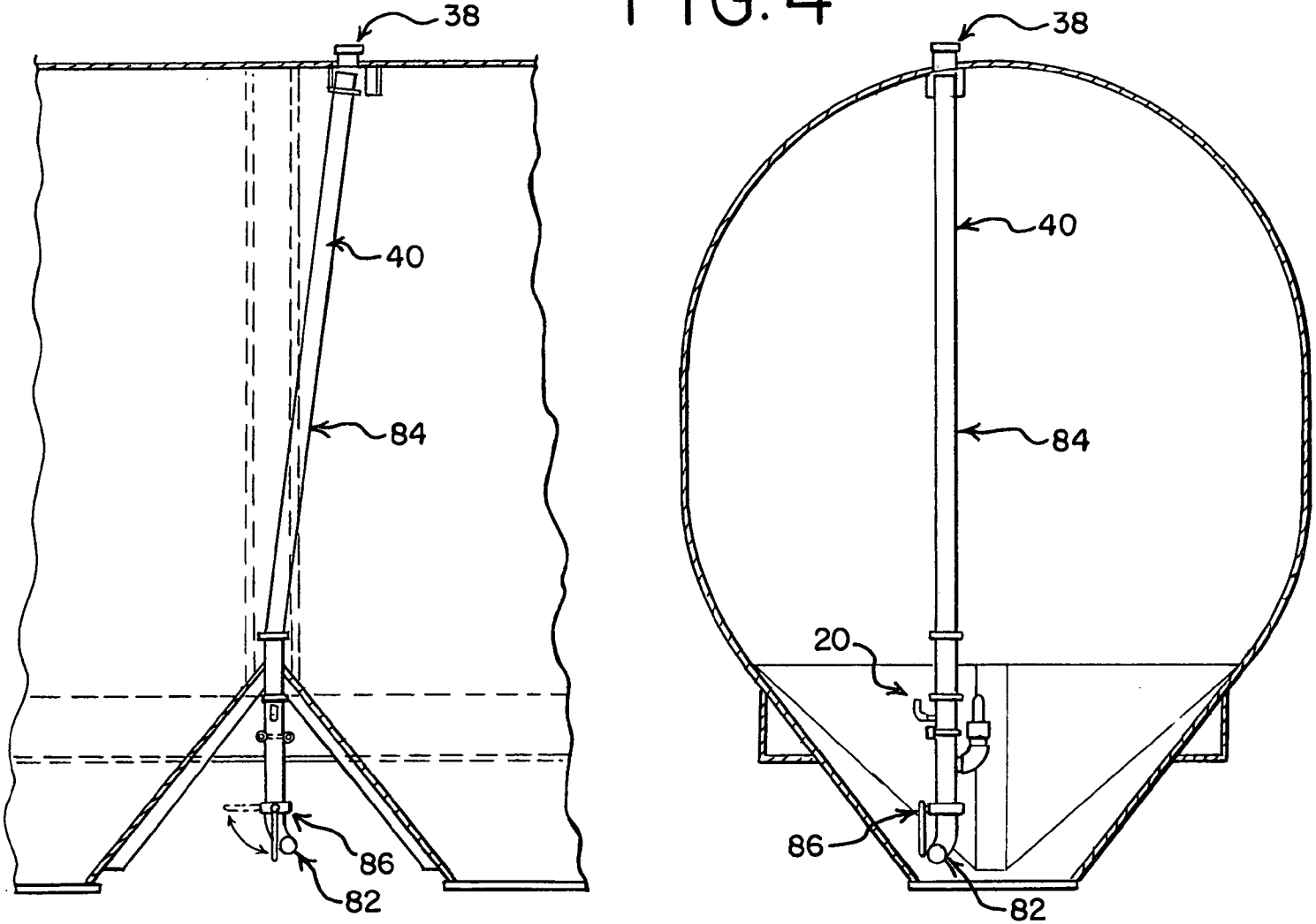
FIG. 4 is a cross-sectional view of a preferred embodiment of a breather assembly utilized in the transportation subassembly of FIG. 3.

Referring now to FIGS. 3 and 4, an inspection and cleanout port 38 communicates with a cleanout conduit 40 which is in fluid communication with the breather subassembly 20, and thereafter in fluid communication with a three-inch standpipe 84 and blowdown valve 86, terminating in a blowdown port 82. The blowdown valve 86 can be opened to exhaust the conduit 40 through the blowdown port 82. The breather subassembly 20 is illustrated in more detail in FIGS. 5 and 6.

A cross-sectional view of a preferred embodiment of a breather subassembly 20 illustrates a cylinder 90 constructed and arranged to receive a contaminant-removing material 26. For the example wherein the material 12 to be transported is sodium percarbonate, the destabilizing contaminant is water and the contaminant removing material 26 is a desiccant. The cylinder 90 is therefore constructed and arranged to receive a desiccant such as, for example, silica based regenerative desiccants.

Figure 5:
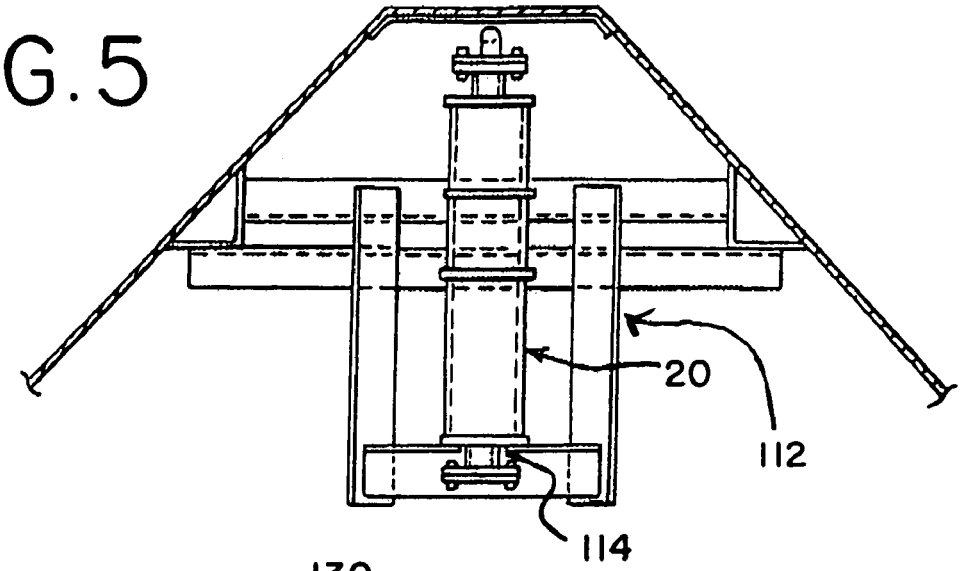
FIG. 5 is a view of the breather assembly support of FIG. 4.

Note that in FIG. 5, a cylinder receiving bracket 112 is shown. The bracket 112 contains a cylinder terminus receiving aperture 114 constructed and arranged to receive a cylinder terminus 116 (shown in FIG. 6) provided at each end of the cylinder 90. The brackets 112 are welded into the railcar 50 as appropriate to positioning the cylinder 90 in a desired location.

Figure 6:
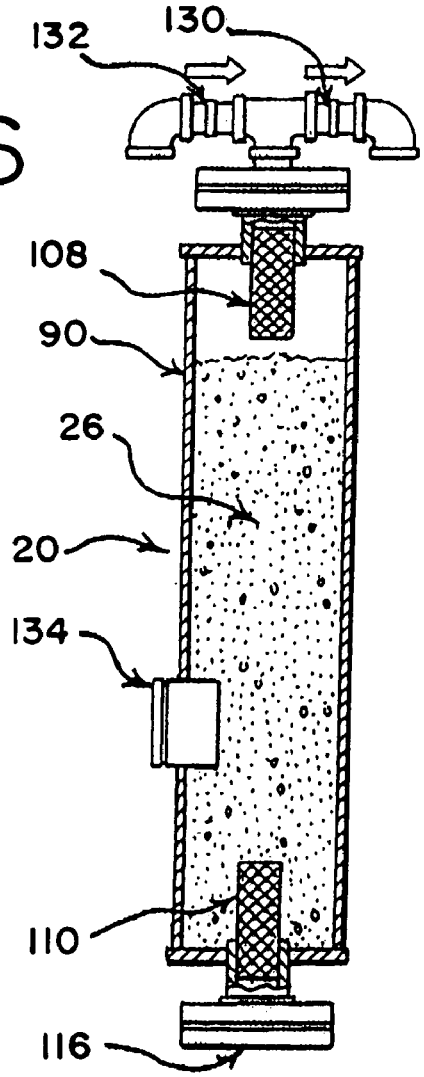
FIG. 6 is a cross-sectional view of a portion of an alternative preferred embodiment of a breather assembly.

FIG. 6 illustrates even more of the features of a variant of the embodiment of breather assembly 20 shown in FIG. 3. As shown in FIG. 6, a breather assembly 20 has a cylinder 90 having weight capacity for receiving a silica based regenerative desiccant of 25 lbs. (in this instance, Kemp K-3 silica based regenerative desiccant). A top screen nozzle 108 and a bottom screen nozzle 110 are provided at opposite ends of the cylinder 90 to prevent outflow of desiccant 26 through orifices in the cylinder 90.

An air inlet check valve 130 and a pressure relief valve 132 are provided at the top of the cylinder 90, to regulate the airflow through the cylinder 90 during storage or transportation of the product. The desiccant 26 is disposed within the cylinder 90 and, because it is a silica based regenerative desiccant, permits airflow through it. Note that a moisture indicator 134 can be mounted on the cylinder to permit visual inspection and determination of a regeneration schedule.

Figure 7:
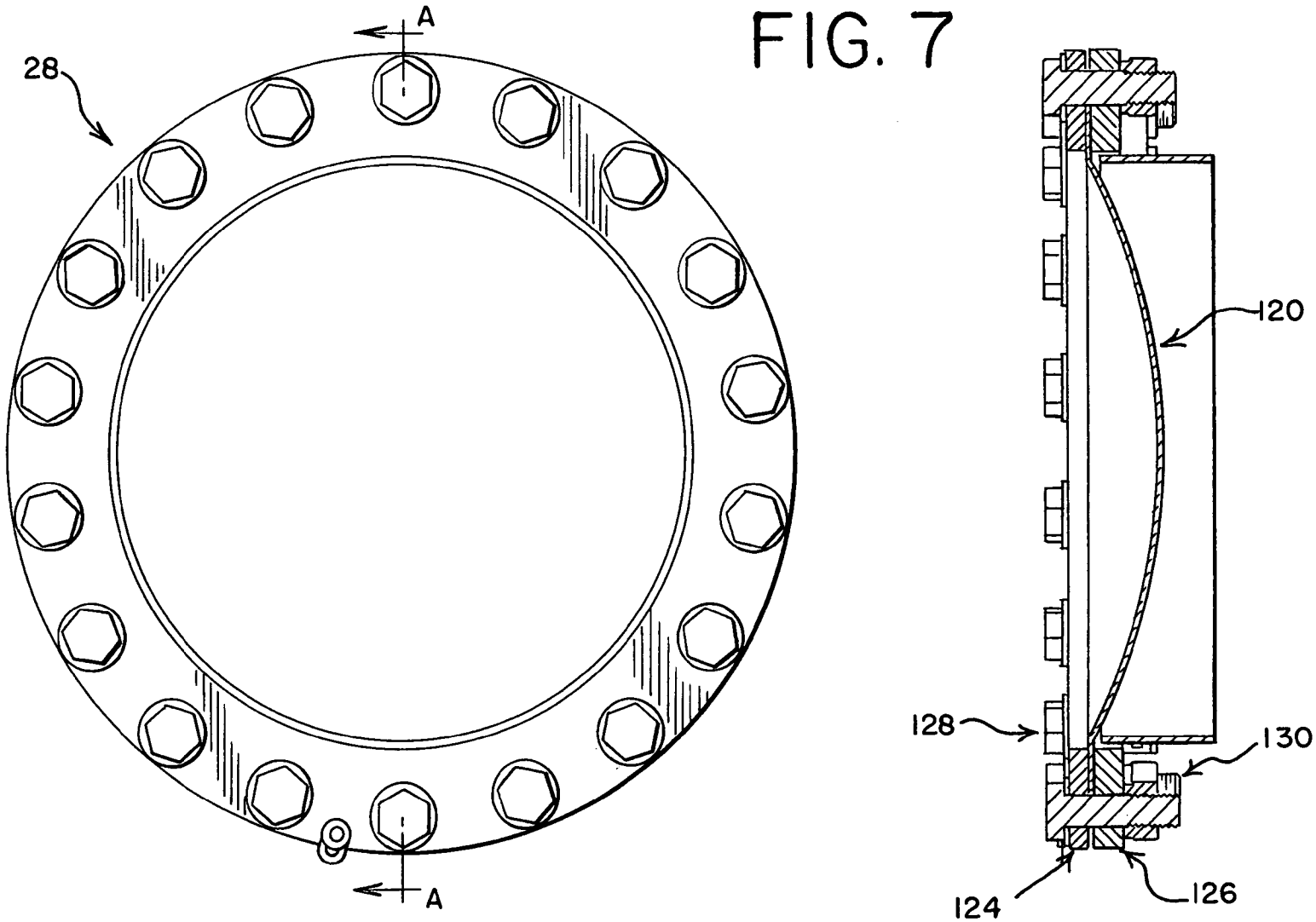
FIG. 7 is a cross-sectional view of a preferred embodiment of a rupture apparatus used with a transportation subassembly.

As shown in FIG. 7, the rupture apparatus 30 has a commonly known configuration and comprises a rupture disc 120, preferably an inverted rupture disc. Constructed preferably of stainless steel and teflon, selected to have a desired rupture pressure, which is received and secured between a top flange plate assembly 124 and a lower flange plate assembly 126. Bolts 128 and nuts 130 (shown in FIG. 7) secure the top plate 124 to the bottom plate 126, generally securing the rupture disc 120 in place. The rupture disc 120 assembly is then mounted to the railcar 50 in desired locations therealong.

The preferred embodiments are constructed and arranged for not only storing, but transporting, a chemical compound rendered unstable in the presence of the destabilizing contaminant. In the most preferred adaptation, the destabilizing contaminant is water and the contaminant removing material 26 is a desiccant. As illustrated, the transportation subassembly 10 is particularly suited to the transportation of sodium percarbonate via railcar. In this instance, the predetermined pressure for the rupture of the rupture apparatus 30 is selected to be between about 20 psi(g) and about 24 psi(g), and is preferably about 22 psi(g).

Thus, a railcar for storing and transporting sodium percarbonate is disclosed. The railcar 50 has a structural body 16 having a hopper forming a cavity 18 wherein a supply of sodium percarbonate is stored. A breather assembly 20 operatively connected to the structural body 16 includes a container 22 forming a chamber 24, the chamber 24 in fluidic communication with the cavity 18 of the hopper and having a desiccant stored therein.

A venting assembly 28 is mounted with respect to the structural body 16, and includes an inverted rupture disc mounted to the hopper and rupturable at a pressure formed within the cavity 18 of about 22 psi(g), thereby forming fluidic communication between the cavity 18 and atmosphere.

Accordingly, the railcar 50, when closed and sealed up, acts as a pressure vessel. Generally, railcars are designed to operate and unload at pressures up to 15 psig. Because of the many fittings and valves on a railcar, the railcar is not completely airtight, but it is sufficiently airtight for commercial purposes.

Before the railcar 50 is loaded with sodium percarbonate 12, the railcar is dried out using dry air. After the car is loaded, the remaining (relatively humid) air is again displaced using dry air. The desiccant cylinder 90 is operatively attached to the air-space of the railcar by a high pressure hose with a valve (not shown), such that the cylinder 90 is in fluid communication with the inside of the railcar 50.

The desiccant cylinder 50 is constructed and arranged to provide dry air to the railcar 50 should the railcar pressure fall below ambient pressure (e.g. to −0.5 psig), as a check valve permits air to enter the railcar 50 through the desiccant cylinder 90. Additionally, the desiccant cylinder 50 is constructed and arranged to accept air from the railcar 50 should the railcar pressure rise above ambient pressure (e.g. to +2.0 psig), as a second check valve will allow the pressure to be relieved through the desiccant cylinder 90. The desiccant cylinder 90 can be isolated during unloading of the railcar by closing the appropriate valves.

Additionally, a method for temporarily storing and transporting sodium percarbonate in a railcar is disclosed. A structural body having a hopper forming a cavity for storing the sodium percarbonate and an inverted rupture disc mounted to the hopper and rupturable at a pressure formed within the cavity is used. The method includes the steps of: inspecting the hopper for defects and the cavity for moisture; dry air purging the cavity; loading the sodium percarbonate into the cavity; activating a breather assembly to restrict moisture from within the cavity; transporting the sodium percarbonate to a desired location having a storage compartment; operatively connecting a dry air line to the at least one hopper to form fluidic communication between the cavity and the storage compartment; unloading the sodium percarbonate into the storage compartment; and maintaining the breather assembly in an activated position to maintain the cavity in a dry condition.

Thus, a transportation subassembly is disclosed, as is a method for storing a material to be transported. While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for transporting a material that is destabilized in the presence of a destabilizing contaminant, the method comprising:

selecting a transportation subassembly comprising a structural body having forming a cavity constructed and arranged to receive the material and having a rupture apparatus rupturable at a predetermined pressure formed within the cavity to form fluidic communication between the cavity and the atmosphere;

inspecting the cavity for defects and for presence of the destabilizing contaminant;

dry air purging the cavity;

loading the material into the cavity;

activating a breather assembly to restrict the destabilizing contaminant from within the cavity;

transporting the material to a desired location having a storage compartment;

operatively connecting a dry air line to the cavity to form fluidic communication between the cavity and the storage compartment;

unloading the material into the storage compartment; and maintaining the breather assembly in an activated position to maintain the cavity in a destabilizing contaminant-free condition.

2. A method for temporarily storing and transporting sodium percarbonate in a railcar comprising a structural body having a hopper forming a cavity for storing the sodium percarbonate and an inverted rupture disc mounted to the hopper and rupturable at a pressure formed within the cavity, the method comprising the steps of:

inspecting the hopper for defects and the cavity for moisture;

dry air purging the cavity;

loading the sodium percarbonate into the cavity;

activating a breather assembly to restrict moisture from within the cavity;

transporting the sodium percarbonate to a desired location having a storage compartment;

operatively connecting a dry air line to the at least one hopper to form fluidic communication between the cavity and the storage compartment;

unloading the sodium percarbonate into the storage compartment; and maintaining the breather assembly in an activated position to maintain the cavity in a dry condition.

* * * * *